US010439332B2

(12) United States Patent
Ju et al.

(10) Patent No.: US 10,439,332 B2
(45) Date of Patent: Oct. 8, 2019

(54) ELECTRICAL CONNECTOR WITH CENTRAL SHIELD

(71) Applicant: LOTES CO., LTD, Keelung (TW)

(72) Inventors: Ted Ju, Keelung (TW); Wu Feng, Keelung (TW); Ya Jun Zeng, Keelung (TW); Nan Fang He, Keelung (TW); Jun Fan, Keelung (TW); Jin Ke Hu, Keelung (TW); Guo Sheng Zhou, Keelung (TW); Chin Chi Lin, Keelung (TW)

(73) Assignee: LOTES CO., LTD, Keelung (TW)

( * ) Notice: Subject to any disclaimer, the term of this patent is extended or adjusted under 35 U.S.C. 154(b) by 50 days.

(21) Appl. No.: 15/648,745

(22) Filed: Jul. 13, 2017

(65) Prior Publication Data

US 2017/0310057 A1 Oct. 26, 2017

Related U.S. Application Data

(63) Continuation of application No. 15/263,413, filed on Sep. 13, 2016, now abandoned, which is a (Continued)

(51) Int. Cl.
*H01R 13/6585* (2011.01)
*H01R 24/60* (2011.01)
(Continued)

(52) U.S. Cl.
CPC ..... *H01R 13/6585* (2013.01); *H01R 12/724* (2013.01); *H01R 13/6581* (2013.01);
(Continued)

(58) Field of Classification Search
CPC ..... H01R 13/6585
(Continued)

(56) References Cited

U.S. PATENT DOCUMENTS 4,824,383 A * 4/1989 Lemke ..... H01R 24/60 439/108
8,790,138 B2 * 7/2014 Wang ..... H01R 27/02 439/607.4
(Continued)

FOREIGN PATENT DOCUMENTS

CN 203445352 U 2/2014
CN 103972732 A 8/2014

*Primary Examiner* — Neil Abrams
(74) *Attorney, Agent, or Firm* — Locke Lord LLP; Tim Tingkang Xia, Esq.

(57) ABSTRACT

An electrical connector includes an insulation body, at least one first terminal and at least one second terminal, and a middle grounding plate. The insulation body has a base and a tongue located in a front end of the base. The first terminal and the second terminal are arranged in the base in an upper row and a lower row, and exposed to an upper surface and a lower surface of the tongue. The middle grounding plate has a body portion fixed to the tongue, and located between the first terminal and the second terminal, the first terminal has a first front edge, the second terminal has a second front edge, and the first front edge, the second front edge and an edge in a front end of the body portion are located in a same vertical plane.

18 Claims, 8 Drawing Sheets

Related U.S. Application Data continuation of application No. 14/626,709, filed on Feb. 19, 2015, now Pat. No. 9,917,405.

(60) Provisional application No. 62/024,728, filed on Jul. 15, 2014, provisional application No. 61/942,830, filed on Feb. 21, 2014.

(51) Int. Cl.

| | |
|---|---|
| ***H01R 13/6581*** | (2011.01) |
| ***H01R 13/6591*** | (2011.01) |
| ***H01R 12/72*** | (2011.01) |
| ***H01R 13/6583*** | (2011.01) |
| ***H01R 13/6594*** | (2011.01) |
| *H01R 107/00* | (2006.01) |

(52) U.S. Cl.
CPC ..... *H01R 13/6583* (2013.01); *H01R 13/6591* (2013.01); *H01R 13/6594* (2013.01); *H01R 24/60* (2013.01); *H01R 2107/00* (2013.01)

(58) Field of Classification Search
USPC ..... 439/607.08, 607.09
See application file for complete search history.

(56) References Cited

U.S. PATENT DOCUMENTS

| | | | | |
|---|---|---|---|---|
| 8,851,927 | B2 * | 10/2014 | Hsu | H01R 12/724 439/607.11 |
| 8,864,506 | B2 * | 10/2014 | Little | H01R 13/658 439/108 |
| 8,968,031 | B2 * | 3/2015 | Simmel | H01R 13/659 439/660 |
| 9,178,319 | B2 * | 11/2015 | Little | H01R 13/6585 |
| 9,276,365 | B2 * | 3/2016 | Yu | H01R 13/6594 |
| 9,281,642 | B1 * | 3/2016 | Tseng | H01R 24/60 |
| 9,300,095 | B2 * | 3/2016 | Lin | H01R 24/60 |
| 9,306,336 | B2 * | 4/2016 | Chang | H01R 13/6471 |
| 9,306,337 | B2 * | 4/2016 | Yu | H01R 24/60 |
| 9,312,641 | B2 * | 4/2016 | Wang | H01R 13/6585 |
| 9,331,433 | B2 * | 5/2016 | Ueda | H01R 13/6581 |
| 9,379,494 | B1 * | 6/2016 | Hu | H01R 13/6594 |
| 9,461,378 | B1 * | 10/2016 | Chen | H01R 12/707 |
| 9,461,388 | B2 * | 10/2016 | Zhao | H01R 13/405 |
| 9,490,580 | B2 * | 11/2016 | Lan | H01R 13/646 |
| 9,525,243 | B1 * | 12/2016 | Yuan | H01R 13/6585 |
| 9,548,568 | B2 * | 1/2017 | Miyoshi | H01R 13/428 |
| 9,653,851 | B1 * | 5/2017 | Yuan | H01R 13/6594 |
| 9,673,569 | B2 * | 6/2017 | Zhang | H01R 13/6585 |
| 9,692,166 | B2 * | 6/2017 | Kao | H01R 24/60 |
| 9,728,899 | B2 * | 8/2017 | Peng | H01R 13/6581 |
| 9,742,121 | B2 * | 8/2017 | Hayashi | H01R 13/6585 |
| 9,748,712 | B2 * | 8/2017 | Guo | H01R 24/60 |
| 9,761,973 | B2 * | 9/2017 | Tsai | H01R 12/716 |
| 9,837,772 | B2 * | 12/2017 | Tsai | H01R 13/502 |
| 9,865,974 | B2 * | 1/2018 | Chen | H01R 24/62 |
| 9,882,316 | B2 * | 1/2018 | Chen | H01R 13/405 |
| 9,917,405 | B2 * | 3/2018 | Ju | H01R 13/6585 |
| 9,923,317 | B2 * | 3/2018 | Yao | H01R 24/62 |
| 9,935,401 | B2 * | 4/2018 | Tsai | H01R 13/652 |
| 9,954,326 | B2 * | 4/2018 | Gou | H01R 12/716 |
| 9,985,393 | B2 * | 5/2018 | Zhao | H01R 12/58 |
| 9,997,850 | B2 * | 6/2018 | Hong | H01R 12/716 |
| 9,997,853 | B2 * | 6/2018 | Little | H01R 13/6471 |
| 9,997,866 | B1 * | 6/2018 | Hsu | H01R 13/5202 |
| 10,008,793 | B2 * | 6/2018 | Ju | H01R 24/78 |
| 10,027,063 | B2 * | 7/2018 | Peng | H01R 12/594 |
| 10,027,066 | B2 * | 7/2018 | Zhong | H01R 13/6597 |
| 10,038,260 | B2 * | 7/2018 | Ju | H01R 24/78 |
| 10,062,992 | B2 * | 8/2018 | Zhao | H01R 24/60 |
| 10,063,014 | B2 * | 8/2018 | Wen | H01R 13/04 |
| 10,063,015 | B2 * | 8/2018 | Zhao | H01R 13/5202 |
| 10,074,927 | B1 * | 9/2018 | Ono | H01R 13/5202 |
| 10,084,245 | B2 * | 9/2018 | Chang | H01R 13/6586 |
| 10,096,936 | B2 * | 10/2018 | Ju | H01R 13/6273 |
| 10,096,947 | B2 * | 10/2018 | Cheng | H01R 13/6581 |
| 10,122,124 | B2 * | 11/2018 | Daughtry, Jr. | H01R 13/405 |
| 10,164,791 | B2 * | 12/2018 | Wang | H01R 12/7023 |
| 10,218,134 | B2 * | 2/2019 | Tsai | H01R 13/6585 |
| 10,236,610 | B2 * | 3/2019 | Lin | H01R 12/721 |
| 10,355,382 | B2 * | 7/2019 | Sato | H01R 4/184 |
| 10,361,518 | B2 * | 7/2019 | Zhang | H01R 13/6582 |
| 2016/0087378 | A1 * | 3/2016 | Chen | H01R 13/6597 439/607.34 |
| 2016/0294121 | A1 * | 10/2016 | Daughtry, Jr. | H01R 13/405 |
| 2017/0302014 | A1 * | 10/2017 | Ju | H01R 24/78 |
| 2017/0310057 | A1 * | 10/2017 | Ju | H01R 13/6585 |
| 2018/0097298 | A1 * | 4/2018 | Ju | H01R 13/04 |

* cited by examiner

100

100

200

ELECTRICAL CONNECTOR WITH CENTRAL SHIELD

CROSS-REFERENCE TO RELATED APPLICATION

This application is a continuation application of U.S. application Ser. No. 15/263,413, filed Sep. 13, 2016, which is a continuation application of U.S. application Ser. No. 14/626,709 (now U.S. Pat. No. 9,917,405), filed Feb. 19, 2015, which itself claims priority to and the benefit of, pursuant to 35 U.S.C. § 119(e), U.S. provisional patent application Ser. No. 61/942,830, filed Feb. 21, 2014, and U.S. provisional patent application Ser. No. 62/024,728, filed Jul. 15, 2014. The entire contents of the above identified applications are incorporated herein by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector having a good shielding effect.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent CN201320378153.0 discloses, in paragraph [0008] of the specification, an electrical connector, which includes an insulation body, a first terminal group retained to the insulation body and a shielding member. The insulation body includes a base and a tongue extending forward. The tongue has a first surface and a second surface disposed opposite to each other. The first terminal group is exposed to the first surface, and the shielding member is disposed at the tongue and located between the first surface and the second surface. The first terminal group includes a grounding terminal. The grounding terminal is provided with a contact portion protruding towards the shielding member and contacting the shielding member. Paragraph [0020] discloses that the shielding member is integrally formed at a mating plate, the first terminal group and the second terminal group are oppositely assembled to the mating plate and then assembled forward to an assembly frame along with the mating plate, forming the insulation body. However, when the electrical connector of such a structure is used for transmitting high-speed signals, electromagnetic radiation produced by the first terminal group and the second terminal group is easy to leak backward, resulting in that crosstalk is produced during signal transmission at tails of the first terminal group and the second terminal group, which affects signal transmission quality of the electrical connector. In addition, terminals of such an electrical connector are simultaneously assembled to the first surface and the second surface, and as there are more terminals and the tongue is smaller, operations are inconvenient, which easily results in that the terminals are not mounted firmly and tilt upward, damaging the whole electrical connector.

Therefore, a heretofore unaddressed need exists in the art to address the aforementioned deficiencies and inadequacies.

SUMMARY OF THE INVENTION

In one aspect, the present invention relates to an electrical connector of which upper and lower grounding plates can cover a base portion of an insulation body to increase coverage of an inner metal shell and achieve a good shielding effect.

In certain embodiments, an electrical connector includes an insulation body, multiple terminals, an inner metal shell, and an outer metal shell. The insulation body has a base and a tongue located in a front end of the base. The multiple terminals are fixedly arranged in the base in upper and lower rows. Each of the upper row of terminals has a contact portion exposed to an upper surface, and each of the lower row of terminals has a contact portion exposed to a lower surface of the tongue. The inner metal shell has at least one covering portion disposed on the upper surface of the tongue, and at least one extending portion extending from the covering portion to the base, and the extending portion covers the base. The outer metal shell wraps the inner metal shell externally.

In one embodiment, the extending portion has at least one contacting arm, and the contacting arm urges against an inner wall of the outer metal shell.

In one embodiment, the end of the contacting arm bends downward to form a positioning portion, the base is provided with a concave slot corresponding to the positioning portion, and the positioning portion is received in the concave slot.

In one embodiment, a first receiving space is depressed from the base, and the extending portion is accommodated in the first receiving space.

In one embodiment, the inner metal shell further has a connection portion for vertically connecting the covering portion and the extending portion.

In one embodiment, the inner metal shell includes an upper grounding plate and a lower grounding plate, the upper grounding plate covers the upper surface of the tongue, and the lower grounding plate adjoins the lower surface of the tongue.

In one embodiment, each of two sides of the tongue is provided with a reserving slot, each of two side walls of the upper grounding plate is provided with a mating portion, each of two side walls of the lower grounding plate is provided with a fixing portion corresponding to the mating portion, and the mating portions and the fixing portions are accommodated in the reserving slot in a mutually mating manner to enable the inner metal shell to wrap a rear end of the tongue.

In one embodiment, the lower grounding plate has a stopping portion, and the stopping portion adjoins a lower surface of the base.

In one embodiment, the upper row of terminals and the lower row of terminals respectively include at least two grounding terminals. The grounding terminals are located at edges of the tongue and are each provided with a protruding portion in a front end thereof. The protruding portions partially protrude beyond the edges of the tongue.

In one embodiment, the upper row terminal and the lower row terminal are symmetrically arranged on the tongue, each terminal in the upper row terminal has a first rear portion disposed in the base, each terminal in the lower row terminal has a second rear portion disposed in the base, and the first rear portion and the second rear portion are arranged in two rows.

In one embodiment, the electrical connector further includes a middle grounding plate. The middle grounding plate includes a flat plate portion retained in the tongue and located between the upper row terminal and the lower row terminal, and a vertical portion extending downward from a rear end of the flat plate portion, and the vertical portion is located between the first rear portion and the second rear portion.

In one embodiment, a snap-fit slot depressed inward is formed on each of the two sides of the tongue, and the flat plate portion is partially exposed to the snap-fit slot.

In one embodiment, the tongue is assembled on the base, a lower surface of the base has a second receiving space, the insulation body further includes a plastic block, and the plastic block is accommodated in the second receiving space and assembled on the base.

Another aspect relates to an electrical connector, including an insulation body having a base and a tongue located in a front end of the base, at least one first terminal and at least one second terminal arranged in the base in an upper row and a lower row and exposed to an upper surface and a lower surface of the tongue, and a middle grounding plate having a body portion fixed to the tongue and located between the first terminal and the second terminal. The first terminal has a first front edge, the second terminal has a second front edge, and the first front edge, the second front edge and an edge in a front end of the body portion are located in a same vertical plane.

In one embodiment, the electrical connector further includes multiple first terminals and multiple second terminals, the first terminals include two grounding terminals, the second terminals include two grounding terminals, the tongue has two side surfaces, each of the two side surfaces is connected to the upper surface and the lower surface, the two grounding terminals of the first terminals are located on the upper surface at a location closest to the side surfaces, and the two grounding terminals of the second terminals are located on the lower surface at a location closest to the side surfaces.

In one embodiment, the electrical connector further includes two third terminals located in a same row with the first terminal and two fourth terminals located in a same row with the second terminal, the third terminals have a third front edge located behind the first front edge, and the fourth terminals have a fourth front edge located behind the first front edge.

In one embodiment, the first terminals are adjacent to two sides of each of the third terminals, and the second terminals are adjacent to two sides of each of the fourth terminals.

In one embodiment, multiple first terminals and multiple second terminals are symmetrically disposed in a vertical direction, and the third terminals and the fourth terminals are symmetrically disposed in the vertical direction.

In one embodiment, the first terminal has an upper board and a first inclined plane, the first inclined plane is disposed at a location on the upper board close to the upper surface, the first inclined plane is connected to the first front edge, and a junction between the first inclined plane and the first front edge is lower than the upper surface; and the second terminal has a lower board and a second inclined plane, the second inclined plane is disposed at a location on the lower board close to the lower surface, the second inclined plane is connected to the second front edge, and a junction between the second inclined plane and the second front edge is higher than the lower surface.

In one embodiment, each of two sides of the body portion is provided with a side edge, a notch is concavely provided on each of the two side edges, and at least one first through hole is disposed between the two notches.

In one embodiment, the body portion is provided with two second through holes which are in front of the first through hole.

In one embodiment, a first protruding portion is convexly disposed on each of the two side edges of the body portion, the first protruding portions are in front of the notches, two third through holes are disposed between the two first protruding portions, and the second through holes are disposed between the third through holes and the first through hole.

In one embodiment, a length of the first through hole along a front-rear direction is respectively larger than a length of each of the second through holes along a front-rear direction and a length of each of the third through holes along a front-rear direction.

In one embodiment, the insulation body is provided with multiple insulation blocks located in the notches, the first through holes, the second through holes and the third through holes respectively.

In one embodiment, the tongue has two side surfaces, each of the two side surfaces is connected to the upper surface and the lower surface, and a snap-fit slot depressed inward is formed on each of the side surfaces, and the side edges are exposed to the snap-fit slots.

In one embodiment, a second protruding portion is convexly disposed on each of the two side edges of the body portion, the second protruding portions are behind the notches, and the second protruding portions are located in the base.

In one embodiment, two fourth through holes are disposed between the two second protruding portions, the fourth through holes are behind the first through hole, and the insulation body is provided with insulation blocks located in the fourth through holes.

In one embodiment, the notch and the second protruding portion on one side of the body portion are continuously disposed in a front-rear direction.

In one embodiment, a step portion is disposed on the tongue at a location close to the base, a thickness of the step portion is greater than a thickness of the tongue and less than a thickness of the base, the side edges are correspondingly exposed to the tongue, and the notches are correspondingly located in the step portion.

In one embodiment, the width between the two notches is the minimum width of the body portion.

In one embodiment, the tongue has a front surface connected to the upper surface and the lower surface respectively, and the first front edge is behind the front surface.

In one embodiment, an outer metal shell is sleeved outside the base and the tongue, and forms an insertion space with the tongue, the outer metal shell has a fifth front edge, the first terminal and the second terminal are both exposed to the insertion space, and the fifth front edge is forward beyond the front surface.

In one embodiment, a first horizontal distance exists between the first front edge and the front surface, a second horizontal distance exists between the front surface and the fifth front edge, and the first horizontal distance is equal to the second horizontal distance.

The present invention has the following beneficial effects: in the electrical connector, the inner metal shell has the extending portion covering an upper surface of the base, which increases coverage of the inner metal shell, effectively improves signal transmission quality at the end of the terminals and improves signal transmission stability of the whole electrical connector. The insulation body is assembled by the base, the plastic block and the tongue, which simplifies the manufacturing process of the insulation body and reduces the manufacturing cost of the electrical connector.

A first terminal and a second terminal are arranged along a vertical direction. The first terminal has a first front edge, the second terminal has a second front edge, and the first front edge, the second front edge and an edge in a front end of the body portion of the middle grounding plate are located in a same vertical plane. The vertical plane can be used as a reference plane during manufacturing of the electrical connector and serve as a reference for the purpose of testing the electrical connector, so as to avoid manufacturing errors and facilitate X-ray detecting process.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
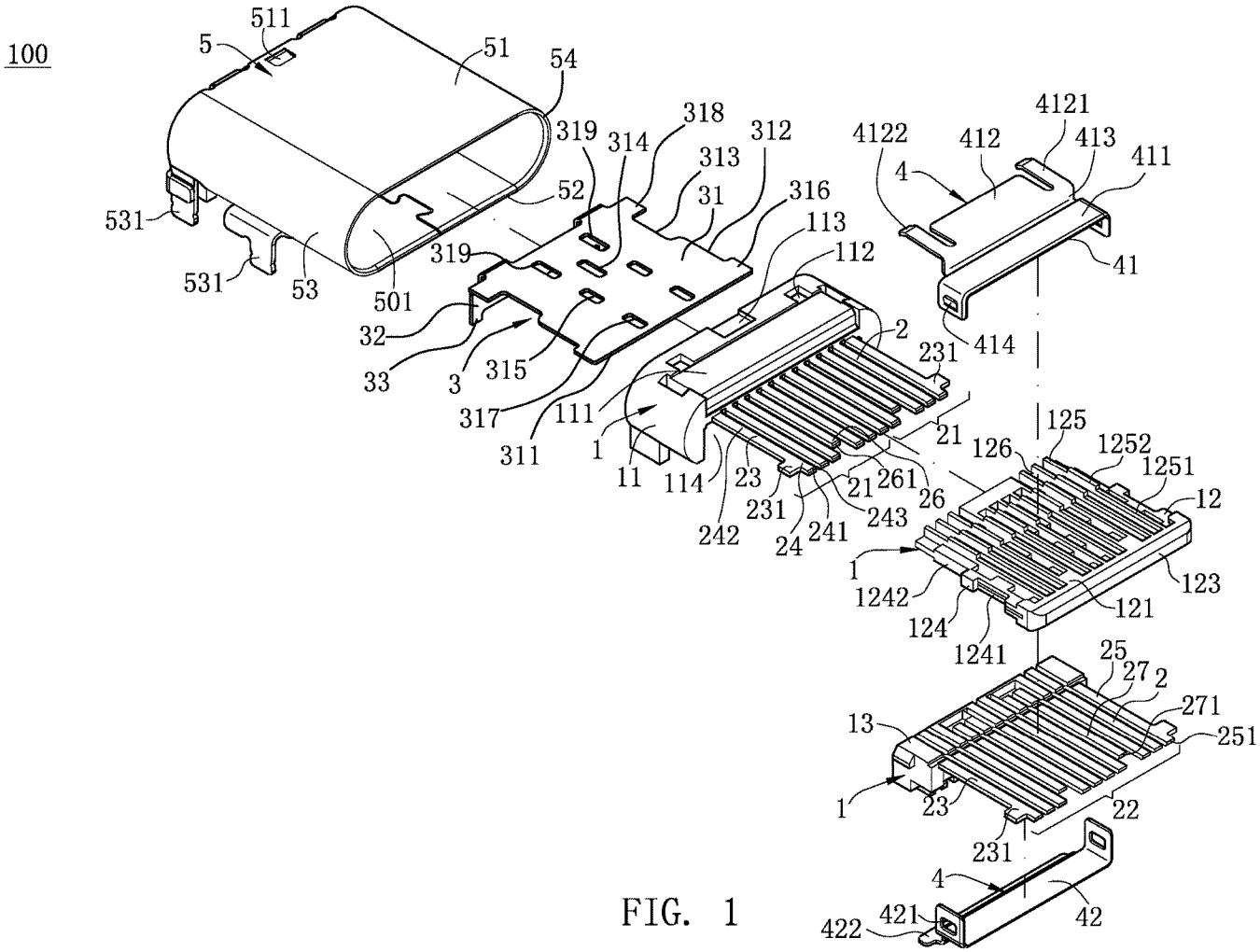
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" and/or "multiple" means two or more.

As used herein, the terms "comprising", "including", "carrying", "having", "containing", "involving", and the like are to be understood to be open-ended, i.e., to mean including but not limited to.

Figure 3:
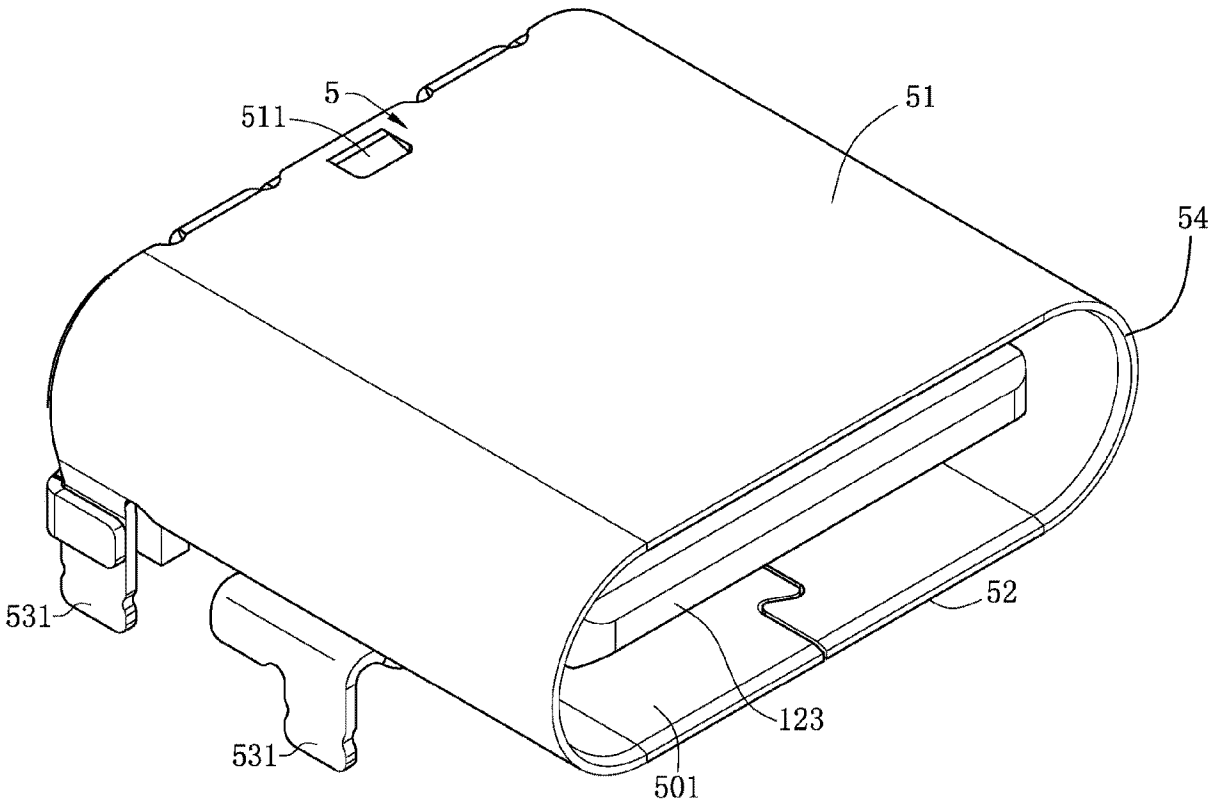
FIG. 3 is a schematic three-dimensional assembly view of an electrical connector according to one embodiment of the present invention.
Figure 6:
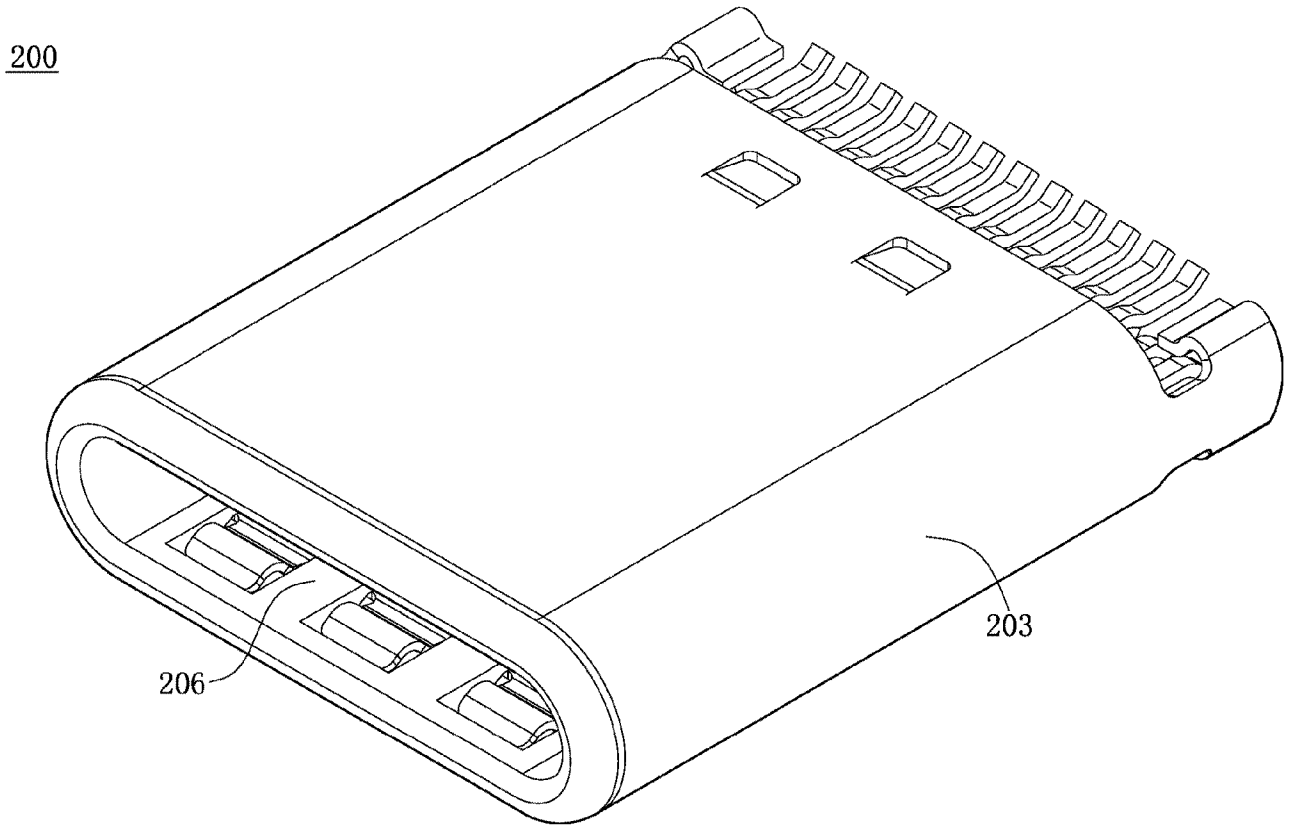
FIG. 6 is a schematic three-dimensional assembly view of a mating connector according to one embodiment of the present invention.

As shown in FIGS. 3 and 6, an electrical connector 100 according to certain embodiments of the present invention is an electrical connector socket that supports high-speed data transmission, and a mating connector 200 is an electrical connector plug that supports high-speed data transmission.

Figure 2:
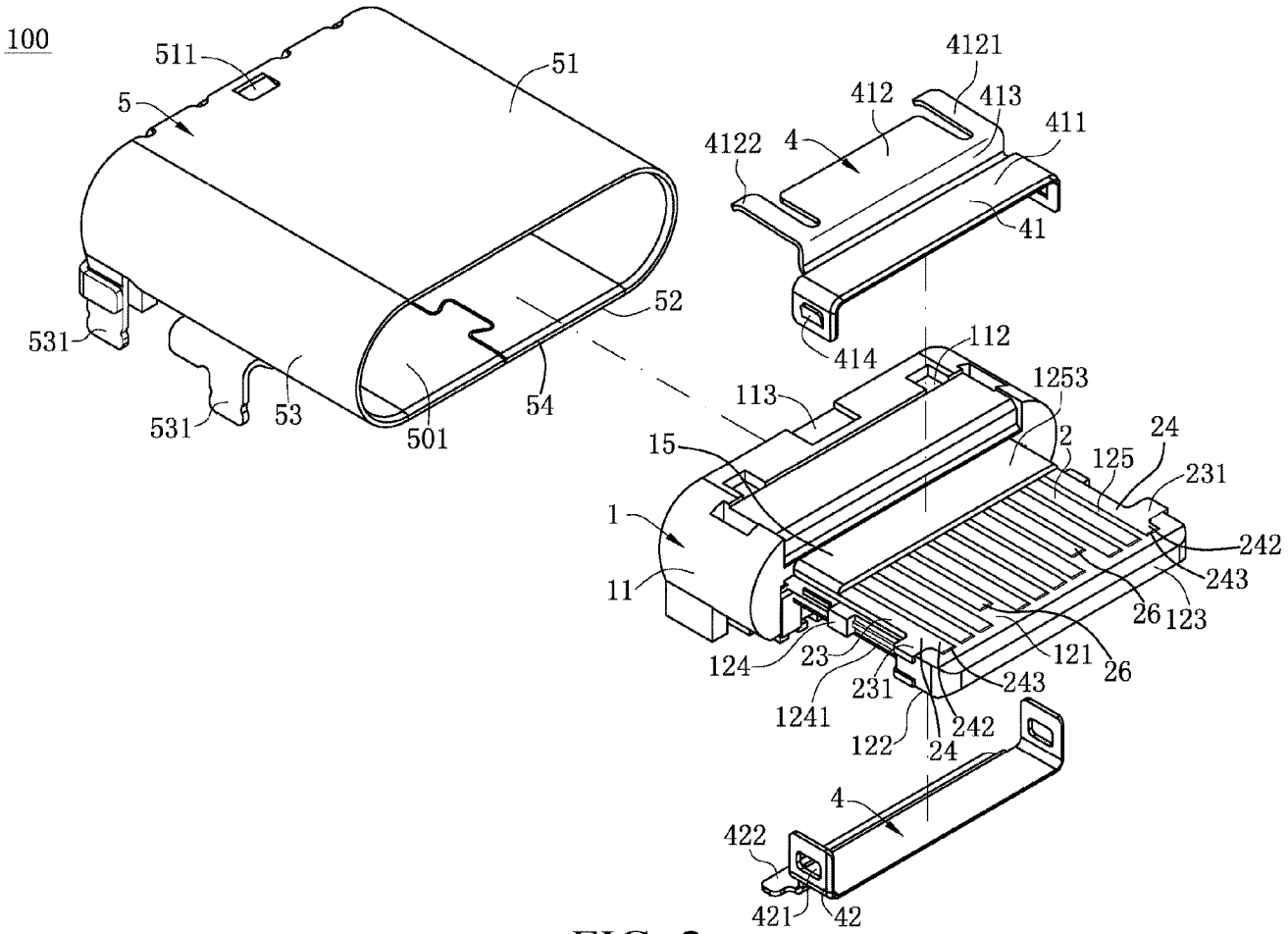
FIG. 2 is a schematic partial three-dimensional exploded view of an electrical connector according to one embodiment of the present invention.

As shown in FIGS. 1-3, the electrical connector 100 includes an insulation body 1, multiple terminals 2 fixed disposed at the insulation body 1; a middle grounding plate 3 fixed disposed at the insulation body 1; an inner metal shell 4 covering and fixed onto the insulation body 1; and an outer metal shell 5 framed outside the insulation body 1 and the inner metal shell 4, to form an insertion space 501. The outer metal shell 5 has multiple soldering pins 531, and the soldering pins 531 can be correspondingly soldered onto a grounding circuit of a circuit board (not shown).

Figure 5:
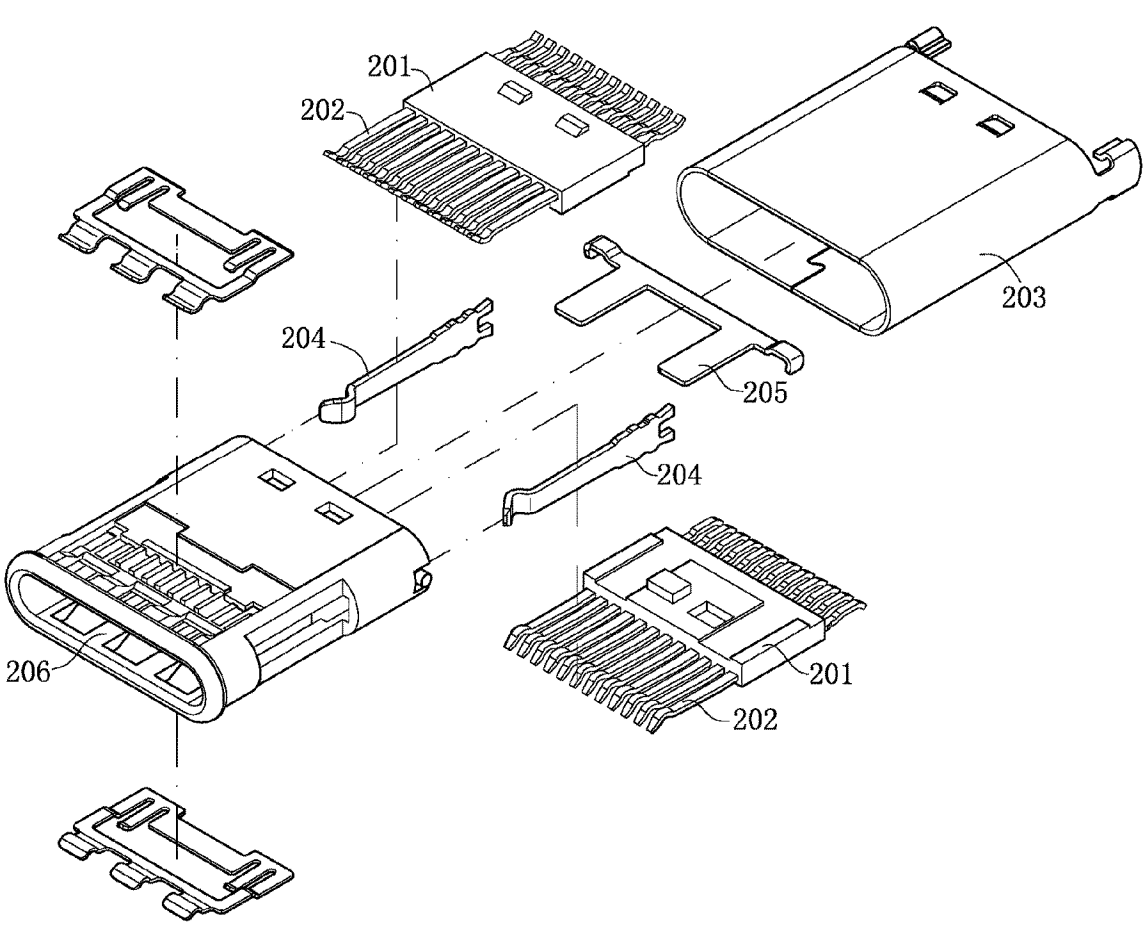
FIG. 5 is a schematic three-dimensional exploded view of a mating connector according to one embodiment of the present invention.
Figure 7:
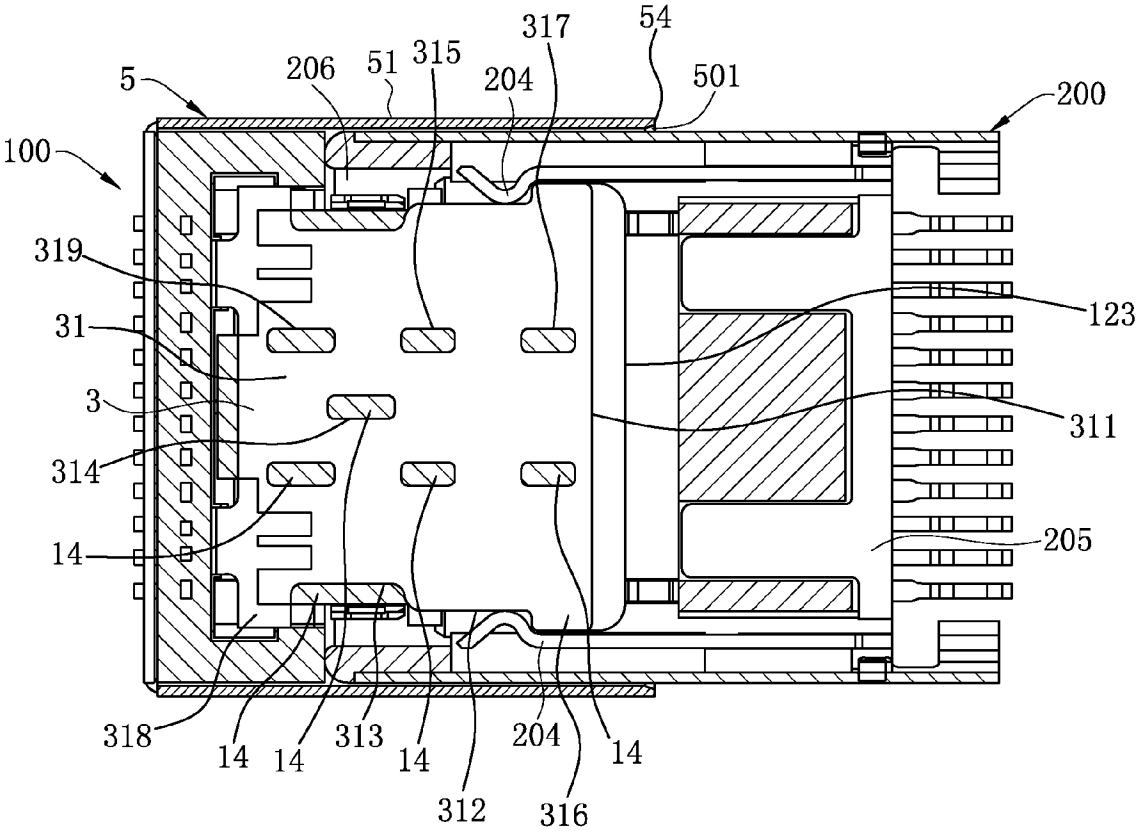
FIG. 7 is a sectional view when an electrical connector according to one embodiment of the present invention mates a mating connector.

As shown in FIGS. 5-7, the mating connector 200 includes a plastic body 201, multiple contact terminals 202 fixed to the plastic body 201, a shielding casing 203 wraps the plastic body 201, a middle shielding sheet 205 fixedly disposed in the plastic body 201, two retaining elastic sheets 204 respectively fixedly disposed to two sides of the plastic body 201, and a mating cavity 206 disposed in a front end of the plastic body 201. When the mating connector 200 is inserted into the insertion space 501 of the electrical connector 100, in addition to that the contact terminals 202 are connected with the corresponding multiple terminals 2, the retaining elastic sheets 204 may contact the middle grounding plate 3 to form a first grounding shielding structure, thus preventing electromagnetic radiation from passing through the insulation body 1 to leak backward to interfere signal transmission of the terminals 2. Moreover, the outer metal shell 5 and the shielding casing 203 form a second grounding shielding structure, which can thus effectively form a wholly surrounded shielding structure.

As shown in FIGS. 1 and 2, in an electrical connector according to a first embodiment of the present invention, the insulation body 1 includes a base 11 and a tongue 12 located in a front end of the base 11, the tongue 12 is assembled to the front end of the base 11, and a plastic block 13 superimposed below the base 11. In other embodiments, the base 11, the tongue 12 and the plastic block 13 may be integrally formed or formed in any other manners, which is not limited herein. A step portion 15 is disposed on the tongue 12 at a location close to the base 11. The thickness of the step portion 15 is greater than the thickness of the tongue 12 and less than the thickness of the base 11.

Figure 4:
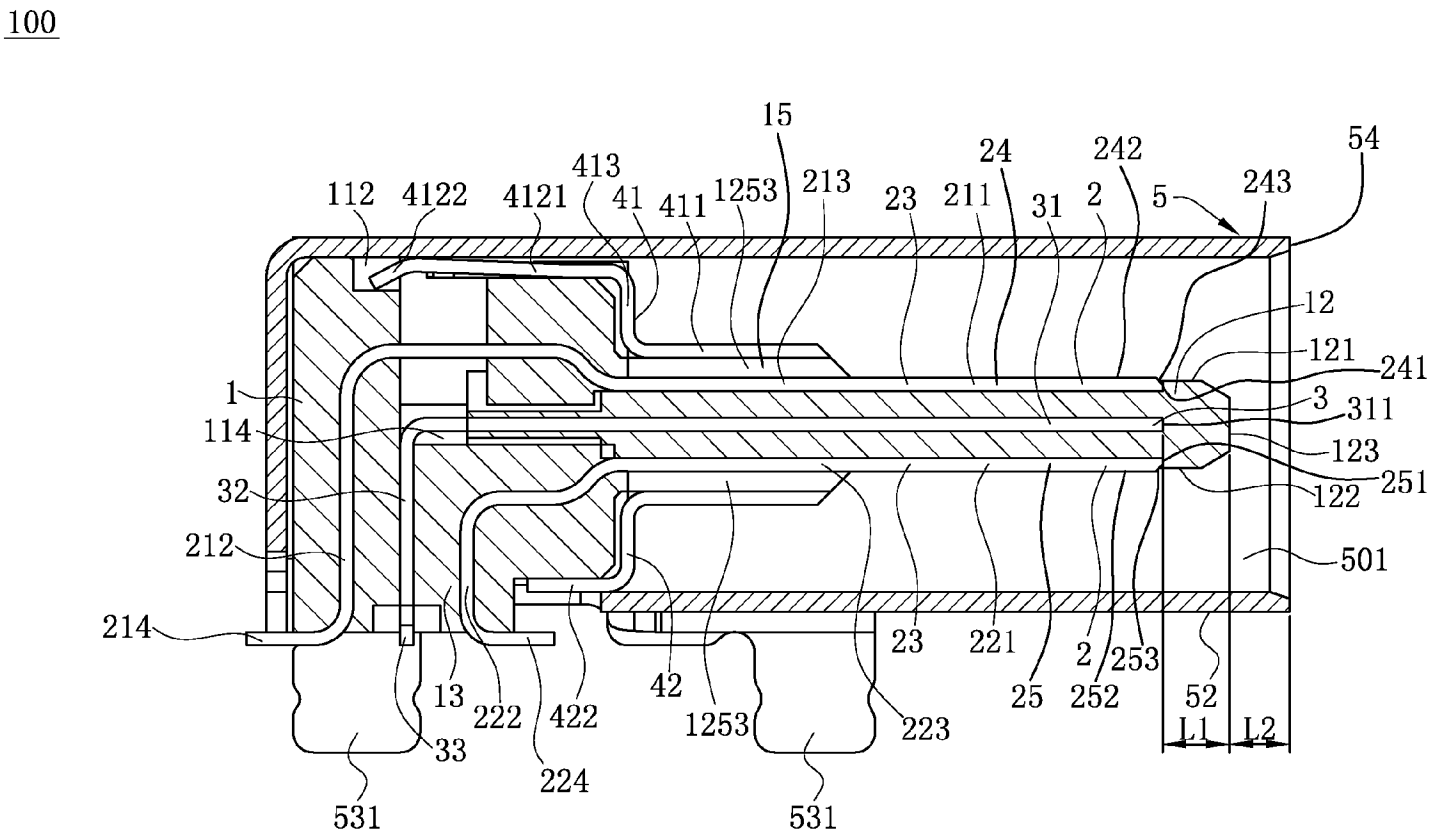
FIG. 4 is a sectional view of the electrical connector according to one embodiment of the present invention.

As shown in FIGS. 1, 4 and 7, a first receiving space 111 is depressed from an upper surface of the base 11 along a vertical direction. Two concave slots 112 are depressed from a rear end of the first receiving space 111. In the vertical direction, the depth of the concave slots 112 is greater than that of the first receiving space 111. The upper surface of the base 11 is further provided with a limiting slot 113, and the limiting slot 113 is in communication with a rear end face of the base 11. A lower surface of the base 11 is provided with a second receiving space 114, and the plastic block 13 is assembled in the second receiving space 114. The tongue 12 has an upper surface 121 and a lower surface 122 opposite up and down, and a front surface 123 and two side surfaces 124 connected between the two surfaces. The upper surface 121 and the lower surface 122 are respectively provided with multiple barriers 125 to form multiple terminal receiving slots 126. The barriers 125 further include a front section 1251 and a rear section 1252, and a thickness dimension of the rear section 1252 is greater than that of the front section 1251, to facilitate that the rear section 1252 has a good hot-melting condition when the insulation body 1 is assembled. A snap-fit slot 1241 depressed inward is further formed in a front end of each of the two side surfaces 124. The snap-fit slots 1241 partially accommodate the retaining elastic sheets 204, to enable the retaining elastic sheets 204 to connect the middle grounding plate 3. A reserving slot 1242 is further formed at a rear end of each of the two side surfaces 1241, for reserving assembly space for the inner metal shell 4.

As shown in FIGS. 1, 2 and 4, the multiple terminals 2 include a group of upper row terminals 21 and a group of lower row terminals 22. The group of upper row terminals 21 include ten first terminals 24 and two third terminals 26. The upper row terminals 21 are integrally formed with the base 11. Each of the upper row terminals 21 includes a first mating portion 211, a first rear portion 212 and a first connection portion 213 connected between the first mating portion 211 and the first rear portion 212. Each of the first terminals 24 and the third terminals 26 includes the first mating portion 211, the first rear portion 212 and the first connection portion 213 connected between the first mating portion 211 and the first rear portion 212. The first mating portion 211 may extend backward to form the first connection portion 213, the first connection portion 213 may bend downward and extend to form the first rear portion 212 that is vertical, and the first rear portion 212 may bend backward and extend to form a first soldering portion 214 that is horizontal. The lower row terminals 22 are integrally formed with the plastic block 13. The group of lower row terminals 22 include ten second terminals 25 and two fourth terminals 27. Each of the lower row terminals 22 includes a second mating portion 221, a second rear portion 222 and a second connection portion 223 connected between the second mating portion 221 and the second rear portion 222. Each of the second terminals 25 and the fourth terminals 27 includes the second mating portion 221, the second rear portion 222 and the second connection portion 223 connected between the second mating portion 221 and the second rear portion 222. The second mating portion 221 may extend backward to form the second connection portion 223, the second connection portion 223 may bend downward and extend to form the second rear portion 222 that is vertical, and the second rear portion 222 may bend forward and extend to form a second soldering portion 224 that is horizontal. When the base 11, the tongue 12 and the plastic block 13 are assembled together, an upper surface of the rear section 1252 forms a flat plate portion 1253 through hot melting to retain the first connection portion 213, and a lower surface of the rear section 1252 forms the flat plate portion 1253 through hot melting to retain the second connection portion 223, preventing the terminals 2 from tilting upward in the terminal receiving slot 126. The first mating portion 211 is correspondingly received in the terminal receiving slot 126 and exposed to the upper surface 121. The second mating portion 221 is correspondingly received in the terminal receiving slot 126 and exposed to the lower surface 122. The first rear portions 212 and the second rear portions 222 are arranged in two rows. The upper row terminal 21 and the lower row terminal 22 further respectively include two grounding terminals 23. The grounding terminals 23 are located at edges of the tongue 12 and each has a protruding portion 231 in front ends thereof, and the protruding portions 231 partially protrude beyond the edges of the tongue 12, avoiding worn out of the tongue 12 during mating of the electrical connector 100. The first mating portions 211 and the second mating portions 221 are symmetrically disposed at 180 degrees in the inserting space 501, thus enabling the mating connector 200 to be inserted into the electrical connector 100 in dual orientation.

As shown in FIGS. 1, 2 and 4, multiple first terminals 24 and multiple second terminals 25 are fixed in the base 11 in an upper row and a lower row respectively, and exposed to an upper surface 121 and a lower surface 122 of the tongue 12. The multiple first terminals 24 include two grounding terminals 23, and the multiple second terminals 25 include two grounding terminals 23. The tongue 12 has two side surfaces 124, and each of the two side surfaces 124 is connected to the upper surface 121 and the lower surface 122. The two grounding terminals 23 of the first terminals 24 are located on the upper surface 121 at a location closest to the side surfaces 124, and the other two grounding terminals 23 of the second terminals 25 are located on the lower surface 122 at a location closest to the side surfaces 124. Two third terminals 26 are located in a same row with the first terminals 24, and the third terminals 26 have a third front edge 261 located behind a first front edge 241 of the first terminals 24. Two fourth terminals 27 are located in a same row with the second terminals 25, and the fourth terminals 27 have a fourth front edge 271 located behind the first front edge 241. The first terminals 24 are adjacent to two sides of each of the third terminals 26, and the second terminals 25 are adjacent to two sides of each of the fourth terminals 27. The multiple first terminals 24 and the multiple second terminals 25 are symmetrically disposed in a vertical direction, and the third terminals 26 and the fourth terminals 27 are symmetrically disposed in the vertical direction, thus enabling the mating connector 200 to be inserted into the electrical connector 100 in dual orientation.

As shown in FIGS. 1, 2 and 4, each first terminal 24 has an upper board 242 and a first inclined plane 243, and the first inclined plane 243 is disposed at a location on the upper board 242 close to the upper surface 121. The first inclined plane 243 is connected to the first front edge 241, and a junction between the first inclined plane 243 and the first front edge 241 is lower than the upper surface 121. The second terminal 25 has a lower board 252 and a second inclined plane 253, and the second inclined plane 253 is disposed at a location on the lower board 252 close to the lower surface 122. Each second inclined plane 253 is connected to the second front edge 251 of the second terminals 25, and a junction between the second inclined plane 253 and the second front edge 251 is higher than the lower surface 122, to prevent the first front edge 241 and the second front edge 251 from scratching the mating connector 200 or the user.

As shown in FIGS. 1, 4 and 7, the middle grounding plate 3 includes a body portion 31, a vertical portion 32, and multiple grounding pins 33. The body portion 31 is retained into the tongue 12 and located between the upper row terminal 21 and the lower row terminal 22, separates the upper row terminal 21 and the lower row terminal 22, and shields signal interference between the upper row terminal 21 and the lower row terminal 22. The body portion 31 is located between the multiple first terminals 24 and the multiple second terminals 25. The first terminals 24 have the first front edge 241, the second terminals 25 have the second front edge 251, and the first front edge 241, the second front edge 251 and an edge 311 in a front end of the body portion 31 are located in a same vertical plane. The first front edge 241 and the second front edge 251 are both behind the front surface 123, to prevent the first front edge 241 and the second front edge 251 from scratching the mating connector 200 or the user.

As shown in FIGS. 1, 4 and 7, each of two sides of the body portion 31 is provided with a side edge 312. The side edges 312 are correspondingly exposed to the tongue 12, and exposed to the snap-fit slot 1241. The side edges 312 are connected with the retaining elastic sheets 204, avoiding that the retaining elastic sheets 204 wear out the snap-fit slot 1241. A notch 313 is concavely provided on each of the two side edges 312, and the notches 313 are correspondingly located in the step portion 15. A first through hole 314 is disposed between the two notches 313. The body portion 31 is provided with two second through holes 315 which are in front of the first through hole 314. A first protruding portion 316 is convexly disposed on each of the two side edges 312 of the body portion 31. The first protruding portions 316 are in front of the notches 313. Two third through holes 317 are disposed between the two first protruding portions 316. The second through holes 315 are disposed between the third through holes 317 and the first through hole 314. The first through hole 314, the second through holes 315 and the third through holes 317 are staggered in a front-rear direction, such that the body portion 31 can be fixed into the insulation body 1 in a balanced way. The length of the first through hole 314 along the front-rear direction is respectively larger than the length of each of the second through holes 315 along a front-rear direction and the length of each of the third through holes 317 along a front-rear direction. As the thickness of the base 11 is greater than that of the tongue 12, the length of the first through hole 314 close to the rear is greater than the length of the second through hole 315 and the third through hole 317 close to the front, facilitating flowing-in and fixing of plastics. The insulation body 1 is provided with multiple insulation blocks 14 located in the notches 313, the first through hole 314, the second through holes 315 and the third through holes 317, respectively, which can ensure that the middle grounding plate 3 is secured in the insulation body 1. A second protruding portion 318 is convexly disposed on each of the two side edges 312 of the body portion 31. The second protruding portions 318 are behind the notches 313. The second protruding portions 318 are located in the base 11, such that the body portion 31 is stably fixed to the base portion 11. Two fourth through holes 319 are disposed between the two second protruding portions 318. The fourth through holes 319 are behind the first through hole 314. The insulation body 1 is provided with insulation blocks 14 located in the fourth through holes 319. The notch 313 and the second protruding portion 318 on one side of the body portion 31 are continuously disposed in a front-rear direction, and are simply shaped. The width between the two notches 313 is the minimum width of the body portion 31. In this way, the insulation blocks 14 are located in the notches 313, and can limit lateral displacement of the body portion 31.

As shown in FIGS. 1, 4 and 7, the body portion 31 is further partially exposed to the snap-fit slot 1241 and connected with the retaining elastic sheets 204. The vertical portion 32 extends downward from a rear end of the body portion 31, is located between the first rear portions 212 and the second rear portions 222, separates the first rear portion 212 and the second rear portion 222, and shields signal interference between the first rear portions 212 and the second rear portions 222. The multiple grounding pins 33 extend downward from the vertical portion 32, used for being soldered onto a grounding circuit of the circuit board (not shown).

As shown in FIGS. 1, 3 and 4, the outer metal shell 5 is sleeved outside the base 11 and the tongue 12, and forms an insertion space 501 with the tongue 12. The outer metal shell 5 has a fifth front edge 54. The first terminal 24 and the second terminal 25 are both exposed to the insertion space 501. The outer metal shell 5 includes a top wall 51, a bottom wall 52 and two side walls 53 connecting the top wall 51 and the bottom wall 52. The fifth front edge 54 is disposed at the forefront of the top wall 51, the bottom wall 52 and the two side walls 53. The fifth front edge 54 is forward beyond the front surface 123. There is a first horizontal distance L1 between the first front edge 241 and the front surface 123, there is a second horizontal distance L2 between the front surface 123 and the fifth front edge 54, and the first horizontal distance L1 is equal to the second horizontal distance L2, facilitating that the mating connector 200 is assembled and limited in the insertion space 501, is assembled precisely and will not tilt. The top wall 51 pierces downward corresponding to the position of the limiting slot 113 to provide an urging portion 511 urging against an inner wall of the limiting slot 113, preventing the outer metal shell 5 from moving forward. In other embodiments, the urging portion 511 may be formed in any other manners, which is not limited herein. A middle portion of each of the side walls 53 extends downward to form a soldering pin 531, a rear end of each of the side walls 53 extends downward to form a soldering pin 531, and the soldering pins 531 are used for being soldered to the circuit board (not shown).

As shown in FIGS. 1 and 4, the inner metal shell 4 includes an upper grounding plate 41 and a lower grounding plate 42. The upper grounding plate 41 includes a covering portion 411, an extending portion 412 and a connection portion 413 vertically connecting the covering portion 411 and the extending portion 412. The covering portion 411 covers the flat plate portion 1253. The extending portion 412 covers an upper surface of the base 11 and is accommodated in the first receiving space 111. Each of two sides of the extending portion 412 has a contacting arm 4121 extending backward and upward. The contacting arms 4121 urges against an inner wall of the outer metal shell 5, to from an electrical connection, making the inner metal shell 4 grounded. The end of each contacting arm 4121 bends downward to form a positioning portion 4122, so that the contacting arm 4121 is in an arc shaped contact with the inner wall of the outer metal shell 5, to facilitate assembling of the outer metal shell 5 to the insulation body 1. The positioning portions 4122 are respectively received in the concave slots 112, preventing the inner metal shell 4 from sliding forward. Each of two side walls of the upper grounding plate 41 is further provided with a mating portion 414, and each of two side walls of the lower grounding plate 42 is provided with a fixing portion 421 corresponding to the mating portion 414. The mating portion 414 and the fixing portion 412 are accommodated in the reserving slots 1242 correspondingly in a mutually mating manner, such that the inner metal shell 4 wraps the insulation body 1. The lower grounding plate 42 further has a stopping portion 422. The stopping portion 422 adjoins a lower surface of the plastic block 13, to firmly assemble the plastic block 13 to the base 11. In other embodiments, the upper grounding plate 41 and the lower grounding plate 42 may be integrally formed, which is not limited herein.

Figure 8:
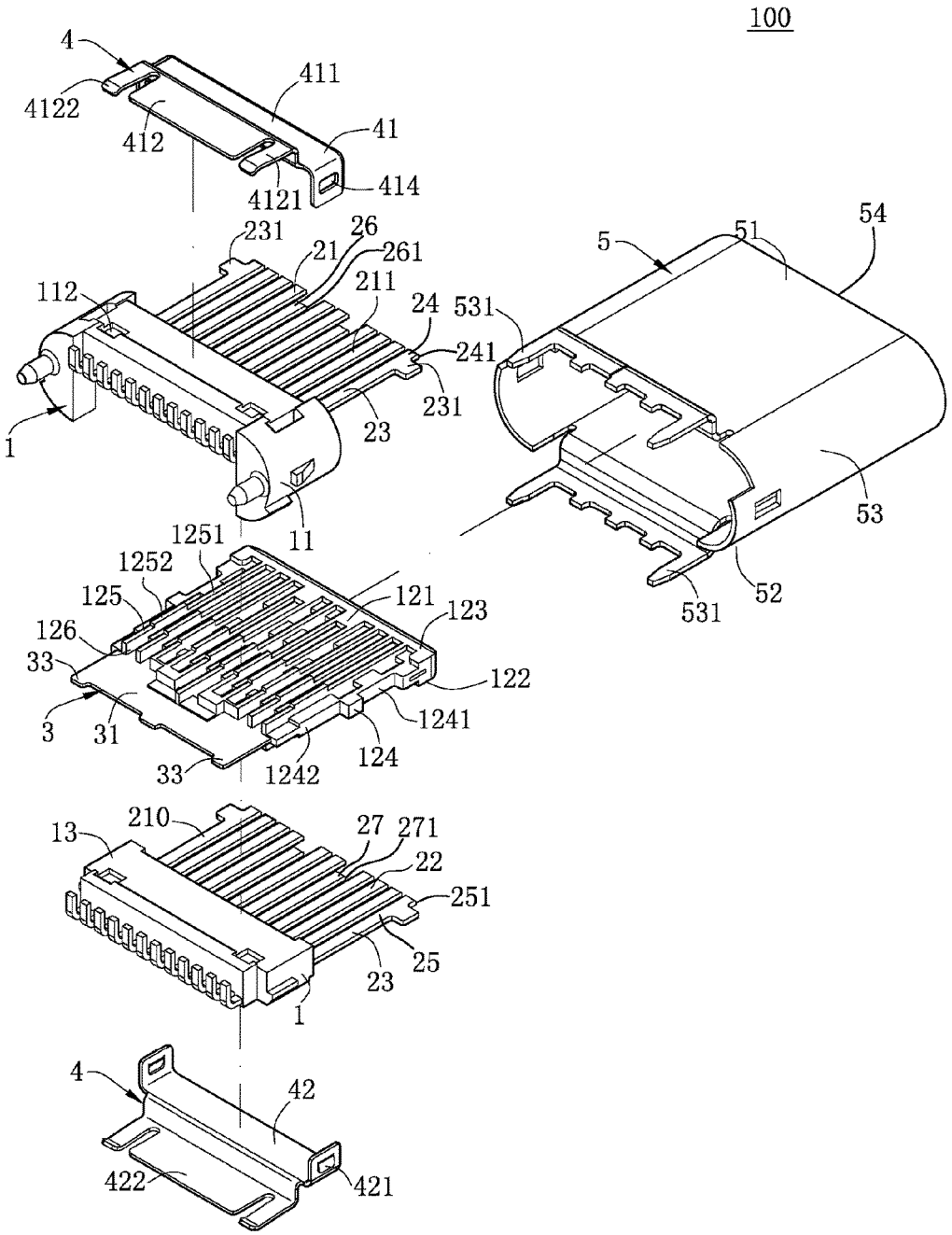
FIG. 8 is a schematic three-dimensional exploded view of a second embodiment of an electrical connector according to one embodiment of the present invention.

FIG. 8 shows an electrical connector 100 according to a second embodiment of the present invention. The second embodiment is different from the first embodiment in that the electrical connector in the second embodiment is a vertical electrical connector. In this embodiment, the middle grounding plate 3 is not provided with the vertical portion 32, the grounding pin 33 also extends in a direction directly from the body portion 31 to the circuit board (not shown), and the soldering pin 531 extends in a direction from the top wall 51 and the bottom wall 52 to the circuit board (not shown).

As shown in FIGS. 1 and 2, in the electrical connector 100, during assembly, firstly, the base 11 and the upper row terminals 21 are integrally formed, the plastic block 13 and the lower row terminals 21 are integrally formed, and the middle grounding plate 3 is integrally fixed into the tongue 12; secondly, the tongue 12 is inserted into the base 11 from front to rear, and the plastic block 13 is assembled to the base 11 from bottom to top; then, the rear section 1252 is correspondingly hot-melted to retain the terminals 2 onto the tongue 12, the upper grounding plate 41 covers the insulation body 1 downward, and the lower grouping sheet 42 covers the insulation body 1 upward; finally, the outer metal shell 5 is sleeved over the insulation body 1 and correspondingly soldered onto the circuit board (not shown).

In summary, the electrical connector 100 according to certain embodiments of the present invention, among other things, has the following beneficial advantages:

(1) The upper grounding plate 41 has the extending portion 412 covering an upper surface of the base 11, the lower grounding plate 42 has the stopping portion 422 adjoining a lower surface of the plastic block 13, which increases coverage of the inner metal shell 4, can more effectively prevent crosstalk caused by that electromagnetic radiation in the insertion space 501 from leaking backward to interfere tails of the terminals 2 when the electrical connector 100 transmits high-speed signals, and improves signal transmission quality of the electrical connector 100.

(2) The middle grounding plate 3 has the vertical portion 32 located between the first rear portion 212 and the second rear portion 222, which effectively shields telecommunication interference between the first rear portions 212 and the second rear portions 222, and enhances signal transmission stability of the electrical connector 100.

(3) The insulation body 1 is composed of the base 11, the tongue 12 and the plastic block 13, which reduces the difficulty of integrally forming the insulation body 1, improves the manufacturing speed of the insulation body 1, and saves the manufacturing cost of the electrical connector 100.

(4) During assembly, the tongue 12 adopts a hot melting method to retain the terminals 2, which makes the terminals 2 not easy to tilt upward on the tongue 12, and prolongs the service life of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulation body, having a base and a tongue located in a front end of the base;

at least one first terminal and at least one second terminal arranged in the base in an upper row and a lower row, and exposed to an upper surface and a lower surface of the tongue; and a middle grounding plate, having a body portion fixed to the tongue, and located between the first terminal and the second terminal, wherein the first terminal has a first front edge, the second terminal has a second front edge, and the first front edge, the second front edge and an edge in a front end of the body portion are located in a same vertical plane;

wherein each of two sides of the body portion is provided with a side edge, a notch is concavely provided on each of the two side edges, a first protruding portion is convexly disposed on each of the two side edges of the body portion, and the first protruding portions are in front of the notches;

wherein the body portion is provided at least one first through hole disposed between the two notches, two second through holes in front the first through hole, and two third through holes disposed between the two first protruding portions, and the second through holes are disposed between the third through holes and the first through hole.

2. The electrical connector according to claim 1, further comprising a plurality of first terminals and a plurality of second terminals, the first terminals include two grounding terminals, the second terminals include two grounding terminals, the tongue has two side surfaces, each of the two side surfaces is connected to the upper surface and the lower surface, the two grounding terminals of the first terminals are located on the upper surface at a location closest to the side surfaces, and the two grounding terminals of the second terminals are located on the lower surface at a location closest to the side surfaces.

3. The electrical connector according to claim 1, further comprising two third terminals located in a same row with the first terminal and two fourth terminals located in a same row with the second terminal, the third terminals have a third front edge located behind the first front edge, and the fourth terminals have a fourth front edge located behind the first front edge.

4. The electrical connector according to claim 3, further comprising a plurality of first terminals and a plurality of second terminals, the first terminals are adjacent to two sides of each of the third terminals, and the second terminals are adjacent to two sides of each of the fourth terminals.

5. The electrical connector according to claim 3, further comprising a plurality of first terminals and a plurality of second terminals, the first terminals and the second terminals are symmetrically disposed in a vertical direction, and the third terminals and the fourth terminals are symmetrically disposed in the vertical direction.

6. The electrical connector according to claim 1, wherein the first terminal has an upper board and a first inclined plane, the first inclined plane is disposed at a location on the upper board close to the upper surface, the first inclined plane is connected to the first front edge, and a junction between the first inclined plane and the first front edge is lower than the upper surface; and wherein the second terminal has a lower board and a second inclined plane, the second inclined plane is disposed at a location on the lower board close to the lower surface, the second inclined plane is connected to the second front edge, and a junction between the second inclined plane and the second front edge is higher than the lower surface.

7. The electrical connector according to claim 1, wherein a length of the first through hole along a front-rear direction is respectively larger than a length of each of the second through holes along the front-rear direction and a length of each of the third through holes along the front-rear direction.

8. The electrical connector according to claim 1, wherein the insulation body is provided with multiple insulation blocks located in the notches, the first through holes, the second through holes and the third through holes respectively.

9. The electrical connector according to claim 1, wherein the tongue has two side surfaces, each of the two side surfaces is connected to the upper surface and the lower surface, and a snap-fit slot depressed inward is formed on each of the side surfaces, and the side edges are exposed to the snap-fit slots.

10. The electrical connector according to claim 1, wherein a second protruding portion is convexly disposed on each of the two side edges of the body portion, the second protruding portions are behind the notches, and the second protruding portions are located in the base.

11. The electrical connector according to claim 10, wherein two fourth through holes are disposed between the two second protruding portions, the fourth through holes are behind the first through hole, and the insulation body is provided with insulation blocks located in the fourth through holes.

12. The electrical connector according to claim 10, wherein the notch and the second protruding portion on one side of the body portion are continuously disposed in a front-rear direction.

13. The electrical connector according to claim 1, wherein a step portion is disposed on the tongue at a location close to the base, a thickness of the step portion is greater than a thickness of the tongue and less than a thickness of the base, the side edges are correspondingly exposed to the tongue, and the notches are correspondingly located in the step portion.

14. The electrical connector according to claim 1, wherein a width between the two notches is a minimum width of the body portion.

15. The electrical connector according to claim 1, wherein the tongue has a front surface connected to the upper surface and the lower surface respectively, and the first front edge is behind the front surface.

16. The electrical connector according to claim 15, wherein an outer metal shell is sleeved outside the base and the tongue, and forms an insertion space with the tongue, the outer metal shell has a fifth front edge, the first terminal and the second terminal are both exposed to the insertion space, and the fifth front edge is forward beyond the front surface.

17. The electrical connector according to claim 16, wherein a first horizontal distance exists between the first front edge and the front surface, a second horizontal distance exists between the front surface and the fifth front edge, and the first horizontal distance is equal to the second horizontal distance.

18. The electrical connector according to claim 1, wherein the first through hole, the second through holes and the third through holes are staggered in a front-rear direction.

* * * * *